US007363932B2

(12) United States Patent
Zheng

(10) Patent No.: US 7,363,932 B2
(45) Date of Patent: Apr. 29, 2008

(54) COLLAPSIBLE STRUCTURES

(75) Inventor: Yu Zheng, Walnut, CA (US)

(73) Assignee: Patent Category Corp., Walnut, CA (US)

( * ) Notice: Subject to any disclaimer, the term of this patent is extended or adjusted under 35 U.S.C. 154(b) by 406 days.

(21) Appl. No.: 11/046,153

(22) Filed: Jan. 28, 2005

(65) Prior Publication Data

US 2005/0126616 A1 Jun. 16, 2005

Related U.S. Application Data

(63) Continuation-in-part of application No. 10/897,597, filed on Jul. 23, 2004, now abandoned, which is a continuation of application No. 09/912,909, filed on Jul. 25, 2001, now Pat. No. 6,766,815, which is a continuation of application No. 09/326,817, filed on Jun. 7, 1999, now Pat. No. 6,267,128.

(51) Int. Cl.
*E04H 15/40* (2006.01)

(52) U.S. Cl. ..... 135/126; 135/117; 135/119; 473/197

(58) Field of Classification Search ..... 135/125–126, 135/128, 117, 119, 143, 901; 473/197, 462; 273/348, 401; 220/9.2–9.3
See application file for complete search history.

(56) References Cited

U.S. PATENT DOCUMENTS 4,632,138 A 12/1986 Irwin
4,815,784 A 3/1989 Zheng
5,024,262 A 6/1991 Huang
5,038,812 A 8/1991 Norman
5,137,044 A * 8/1992 Brady ..... 135/126
5,213,147 A 5/1993 Zheng
5,301,705 A 4/1994 Zheng
5,411,046 A * 5/1995 Wan ..... 135/126
5,439,018 A 8/1995 Tsai
5,467,794 A * 11/1995 Zheng ..... 135/125
5,560,385 A 10/1996 Zheng
5,569,094 A * 10/1996 Macaluso ..... 473/197
D375,928 S 11/1996 Wang
5,592,961 A 1/1997 Chin
5,609,528 A * 3/1997 Kehoe ..... 473/157
5,664,596 A * 9/1997 Zheng ..... 135/126
5,671,479 A 9/1997 Dedrick
5,722,446 A 3/1998 Zheng
5,732,759 A 3/1998 Wang
5,778,915 A 7/1998 Zheng (Continued)

*Primary Examiner*—Winnie Yip
(74) *Attorney, Agent, or Firm*—Raymond Sun

(57) ABSTRACT

A collapsible structure has a first end panel and a second end panel, with each end panel having a foldable frame member having a folded and an unfolded orientation, and a fabric material covering the frame member to form the respective end panel when the frame member is in the unfolded orientation. The structure also has a side wall having at least one panel, a first side and a second side, with the panel having a foldable frame member having a folded and an unfolded orientation. The first side of the side wall is stitched to the fabric of the first end panel at a location away from the periphery of the first end panel, the second side of the side wall is stitched to the fabric of the second end panel at a location away from the periphery of the second end panel.

17 Claims, 12 Drawing Sheets

U.S. PATENT DOCUMENTS 5,800,067 A 9/1998 Easter
5,816,954 A 10/1998 Zheng
5,964,533 A * 10/1999 Ziglar ..... 383/36
6,109,281 A 8/2000 Lowenthal
6,155,329 A 12/2000 Hwang et al.

* cited by examiner

COLLAPSIBLE STRUCTURES

RELATED CASES

This is a continuation-in-part of Ser. No. 10/897,597, filed Jul. 23, 2004, now abandoned, which is a continuation of Ser. No. 09/912,909, filed Jul. 25, 2001, now U.S. Pat. No. 6,766,815, which is a continuation of Ser. No. 09/326,817, filed Jun. 7, 1999, now U.S. Pat. No. 6,267,128.

BACKGROUND OF THE INVENTION

1. Field of the Invention

The present invention relates to collapsible structures, and in particular, to collapsible structures which may be provided in a variety of shapes and sizes. The collapsible structures may be twisted and folded to reduce the overall size of the play structures to facilitate convenient storage and use.

2. Description of the Prior Art

Collapsible objects have recently become popular with both adults and children. Many of these collapsible objects have a plurality of panels which may be twisted and folded to reduce the overall size of the object to facilitate convenient storage and use. Each panel is comprised of a fabric or material that is supported by a resilient frame member, with the fabric or material spanning a portion of, or entirely across, the area supported by the frame member. The frame member supports the periphery of each panel, and is capable of being twisted and folded to reduce the size of each panel.

Examples of such collapsible objects are shown and described in U.S. Pat. No. 5,467,794 (Zheng), U.S. Pat. No. 5,560,385 (Zheng) and U.S. Pat. No. 5,778,915 (Zheng) in the form of collapsible structures. These structures are currently being enjoyed by many people in many different applications. For example, these structures have been provided in many different shapes and sizes for children's play indoors and outdoors. Smaller versions of these structures have been used as infant nurseries. Even smaller versions of these structures have been used as dollhouses and action figure play houses by toddlers and children. As another example, these structures have been made into tents or outdoor structures that can be used by adults and children for camping or other outdoor purposes. These structures have also been used as beach cabanas. Even animals can enjoy these structures. Some of these structures have been made into shelters that can be used by pets, both indoors and outdoors.

The wide-ranging uses for these collapsible structures can be attributed to the performance, convenience and variety that these structures provide. When fully expanded, these structures are stable and can be used as a true shelter without the fear of collapse. These structures are easily twisted and folded into a compact configuration to allow the user to conveniently store the structures. The light-weight nature of the materials used to make these structures makes it convenient for them to be moved from one location to another. These structures also provide much variety in use and enjoyment. For example, a child can use a structure both indoors and outdoors for different play purposes, and can use the same structure for camping.

Another example of collapsible objects includes collapsible game and play structures, such as those illustrated in U.S. Pat. No. 5,722,446 (Zheng) and U.S. Pat. No. 5,816,954 (Zheng). These structures provide a multitude of game structures that can be enjoyed by children and adults indoors and outdoors.

SUMMARY OF THE DISCLOSURE

The present invention provides a collapsible structure having a first end panel and a second end panel, with each end panel having a foldable frame member having a folded and an unfolded orientation, and a fabric material covering the frame member to form the respective end panel when the frame member is in the unfolded orientation. The structure also has a side wall having at least one panel, a first side and a second side, with the panel having a foldable frame member having a folded and an unfolded orientation. The first side of the side wall is stitched to the fabric of the first end panel at a location away from the periphery of the first end panel, the second side of the side wall is stitched to the fabric of the second end panel at a location away from the periphery of the second end panel.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

The present invention illustrates basic principles that can be utilized for coupling adjacent panels of a collapsible structure. Although the present disclosure illustrates certain structural configurations in which these coupling principles are embodied, it will be appreciated by those skilled in the art that the underlying principles of the present invention can be applied to collapsible structures having different shapes and sizes, and incorporating different numbers and arrangements of panels.

Figure 1:
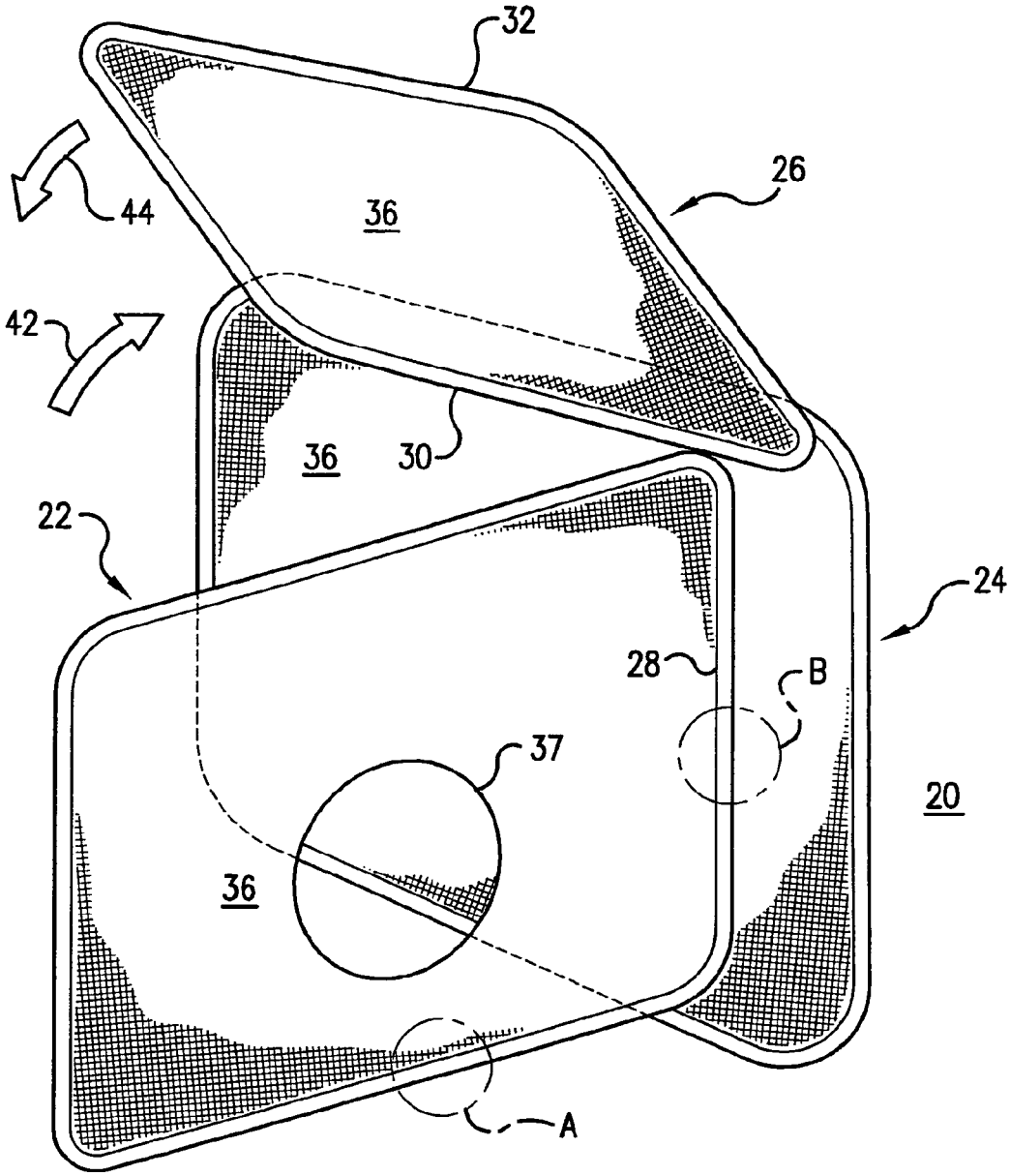
FIG. 1 is a perspective view of a collapsible structure according to one embodiment of the present invention.

According to a first embodiment of the present invention, a side of a panel is stitched to the fabric of an adjacent panel to hingedly attach the two adjacent panels together. The basic principles for this embodiment are illustrated in FIG. 1, where the structure 20 has three panels 22, 24 and 26 that are connected to each other. The three panels include a first side panel 22 and a second side panel 24 that are hingedly connected together to form a corner, and a top panel 26 that is hingedly connected to the second side panel 24. The first side panel 22 has a side 28 that is hingedly connected to the second side panel 24 in the manner described below, and the top panel 26 has a side 30 that is also hingedly connected to the second side panel 24 in the manner described below. In the structure 20, each of the panels 22, 24, 26 is illustrated as having four sides, although this is merely for illustrative purposes and each panel can have any number of sides and can assume any shape and size. The structure 20 shown in FIG. 1 can be used as a partition, among other possible uses.

Figure 2:
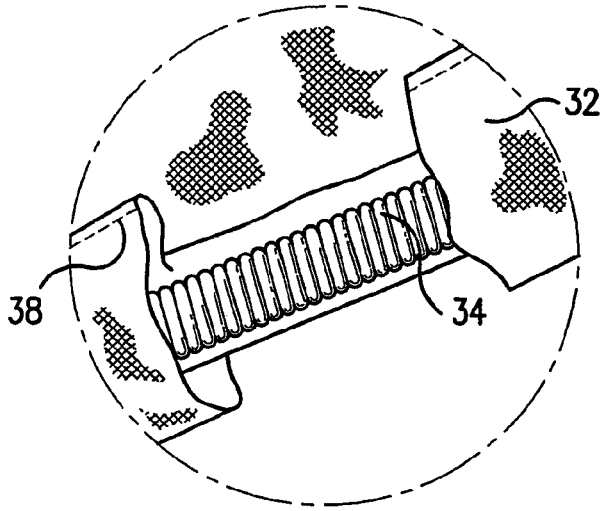
FIG. 2 is a partial cut-away view of the section A of the structure of FIG. 1 illustrating a frame member retained within a sleeve.

Each panel 22, 24, 26 has a continuous frame retaining sleeve 32 provided along and traversing the edges of all of its sides. As shown in FIG. 2, each sleeve 32 may be formed by folding a piece of fabric and applying a stitching 38 to enclose the sleeve. A frame member 34 is retained or held within each frame retaining sleeve 32 to support each panel 22, 24, 26. Only one frame member 34 is shown in FIG. 2; the other frame members are not shown but are the same as frame member 34. The frame members 34 may be provided in the form of one continuous loop, or may comprise a strip of material connected at both ends to form a continuous loop, or merely retained in the sleeve 32 with both ends unconnected. The frame members 34 are preferably formed of flexible coilable steel having a memory, although other materials such as plastics may also be used. The frame members 34 should be made of a material which is relatively strong and yet is flexible to a sufficient degree to allow it to be coiled. Thus, each frame member 34 is capable of assuming two positions or orientations, an open or expanded position such as shown in FIG. 1 in connection with a corresponding panel, or a folded position in which the frame member 34 is collapsed into a size which is much smaller than its open position (see FIG. 5E in connection with a corresponding panel).

Fabric or sheet material 36 extends across each panel 22, 24, 26 and is held taut by the respective frame member 34 when in its open position. The fabric 36 for a particular panel 22, 24 or 26 is stitched to its corresponding frame retaining sleeve 32. The fabric 36 can extend completely across the panel to entirely cover the space enclosed by the frame member 34, or can extend across selected portions of the space enclosed by the frame member 34. For example, the fabric 36 of panel 22 has an opening 37, so that the fabric 36 does not extend across the entire space enclosed by the frame member 34. The term fabric is to be given its broadest meaning and should be made from strong, lightweight materials and may include woven fabrics, sheet fabrics or even films and meshed materials. The fabric should be water-resistant and durable to withstand the wear and tear associated with rough treatment by children. The frame members 34 may be merely retained within the respective frame retaining sleeves 32, without being connected thereto. Alternatively, the frame retaining sleeves 32 may be mechanically fastened, stitched, fused, or glued to the frame members 34 to retain them in position.

Figure 3:
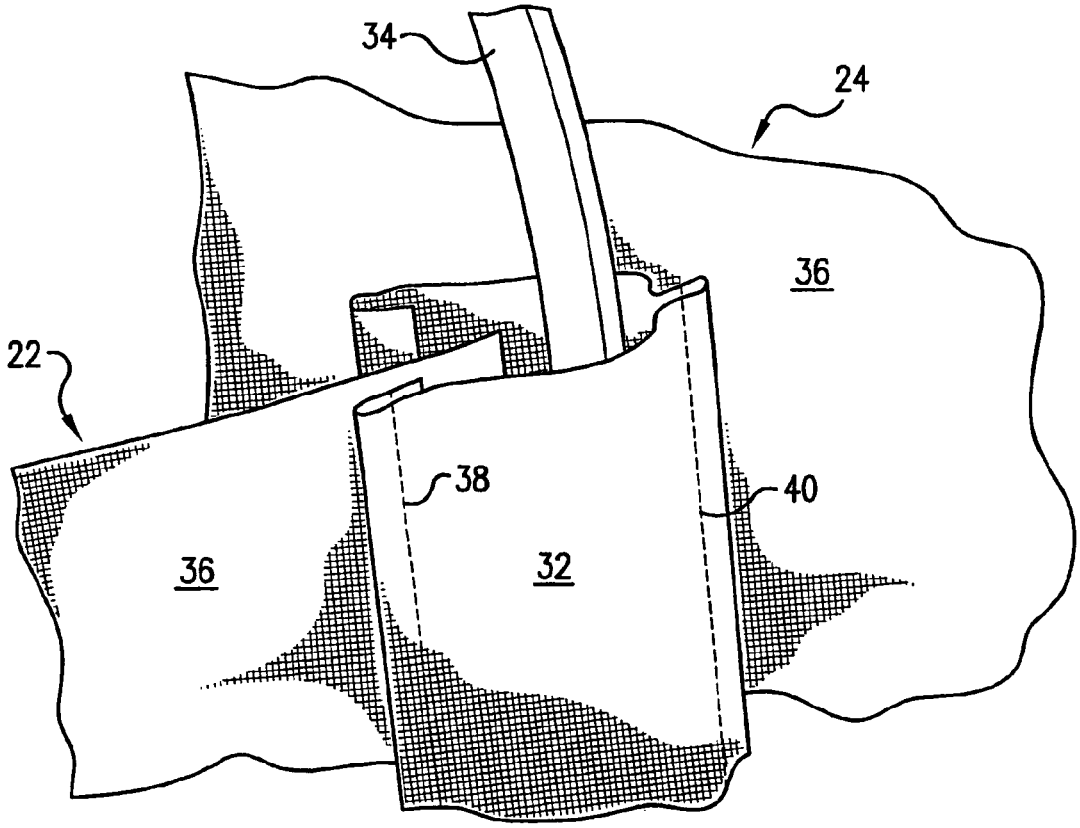
FIG. 3 is an expanded view of the section B of the structure of FIG. 1 illustrating the connection between two adjacent panels.

FIG. 3 illustrates how the side 28 of the panel 22 is hingedly connected to the panel 24. The sleeve 32 of the panel 22 is stitched directly to the fabric 36 of the panel 24 by a stitching 40 at any desired location of the fabric 36 on the panel 24. The stitching 40 can extend along the entire side 28. The stitching 40 also acts as a hinge for the panels 22 and 24 to be folded upon each other, as explained below. The side 30 of the top panel 26 can be hingedly connected to the fabric 36 of the panel 24 in the same way.

The panels 22, 24, 26 may be folded and collapsed to reduce the overall size of the panels for storage. The panel 22 is first folded towards the panel 24 in the direction of arrow 42, and the panel 26 is folded towards panels 22, 24 in the direction of arrow 44, so as to form a stack of three panels 26, 22, 24 (in one possible order) which can be twisted and collapsed using the techniques and principles described in connection with FIGS. 5C-5E below.

Figure 4:
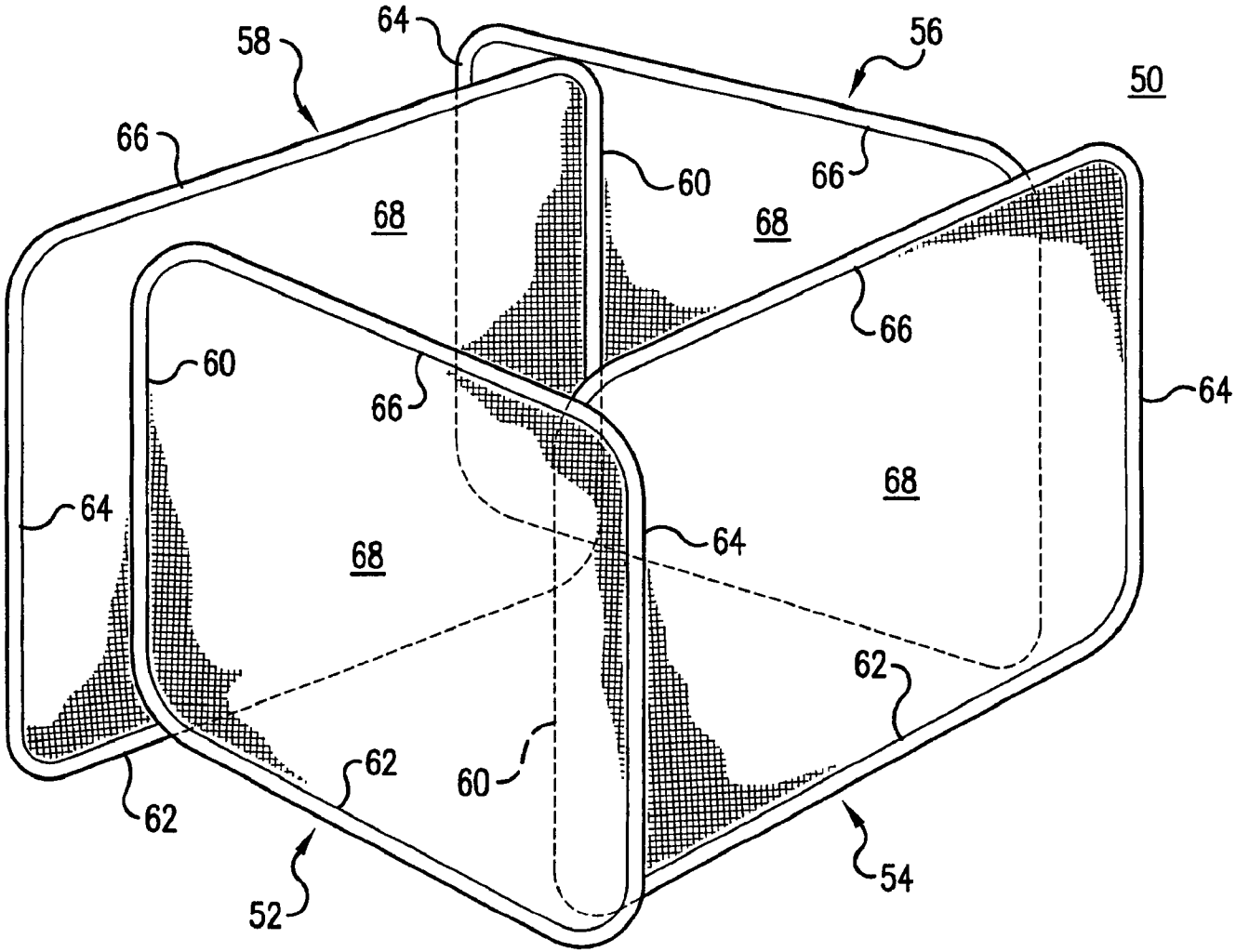
FIG. 4 is a perspective view of a collapsible structure according to another embodiment of the present invention.

FIG. 4 illustrates another structure 50 having its panels hingedly connected according to the principles illustrated in FIGS. 1-3. Structure 50 has four panels 52, 54, 56 and 58 connected to each other to encircle an enclosed space. Each panel 52, 54, 56 and 58 has four sides, including a first side 60, a second side 62, a third side 64 and a fourth side 66. The first side 60 of each panel is hingedly connected to the fabric 68 of an adjacent panel to form the structure 50. The hinged connections of the first sides 60 to the fabrics 68 can be the same as that illustrated in FIG. 3 above. Again, even though each of the panels 52, 54, 56, 58 is illustrated as having four sides, this is merely for illustrative purposes only and each panel can have any number of sides and can assume any shape and size. As a non-limiting example, the structure 50 shown in FIG. 4 can be used as a partition or play structure, and if a roof fabric (not shown) is attached to the top sides of the panels 60, 62, 64, 66, can be used as a tent, shelter, cabana or similar structure.

Figure 5A:
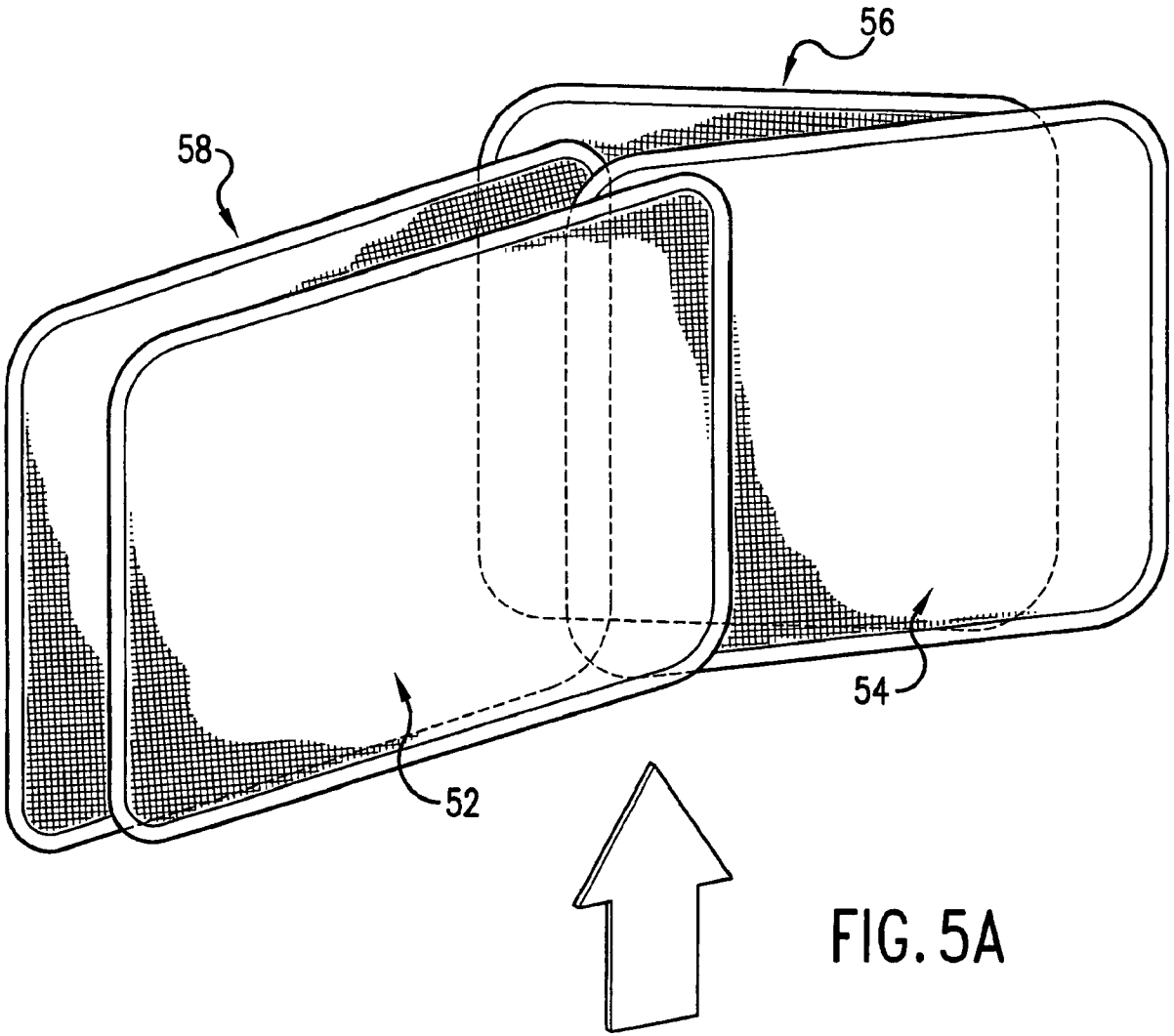
FIGS. 5A through 5E illustrate how the collapsible structure of FIG. 4 may be twisted and folded for compact storage.
Figure 5B:
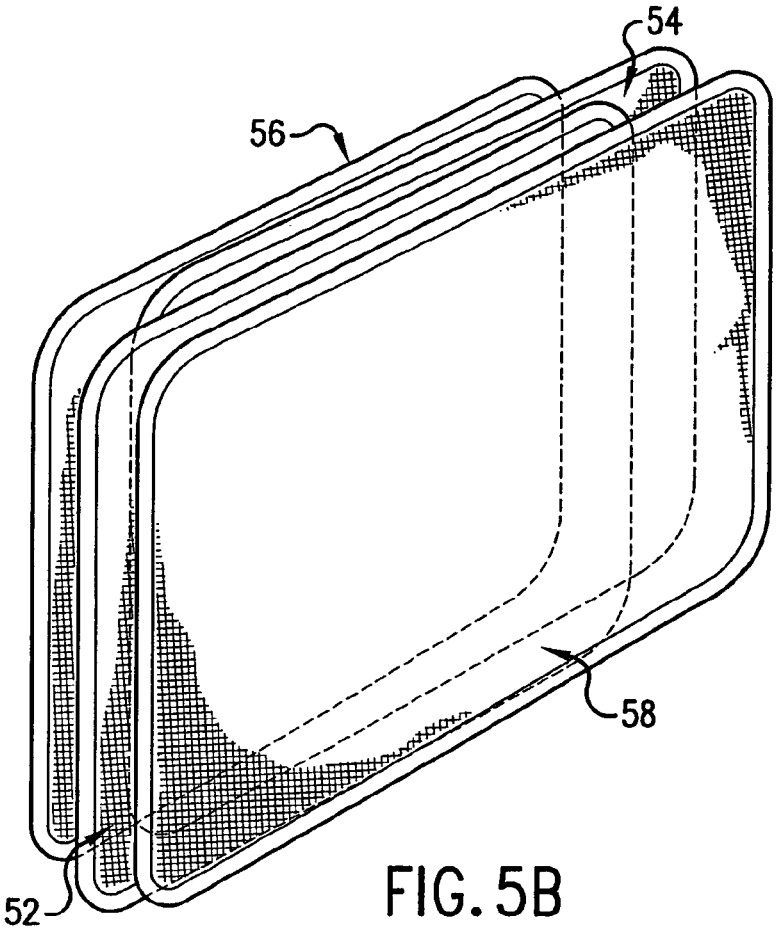
Figure 5C:
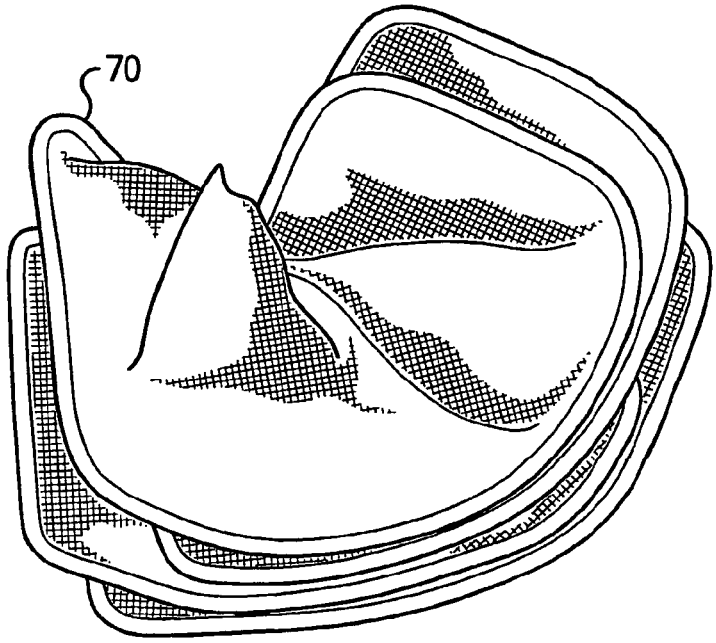
Figure 5D:
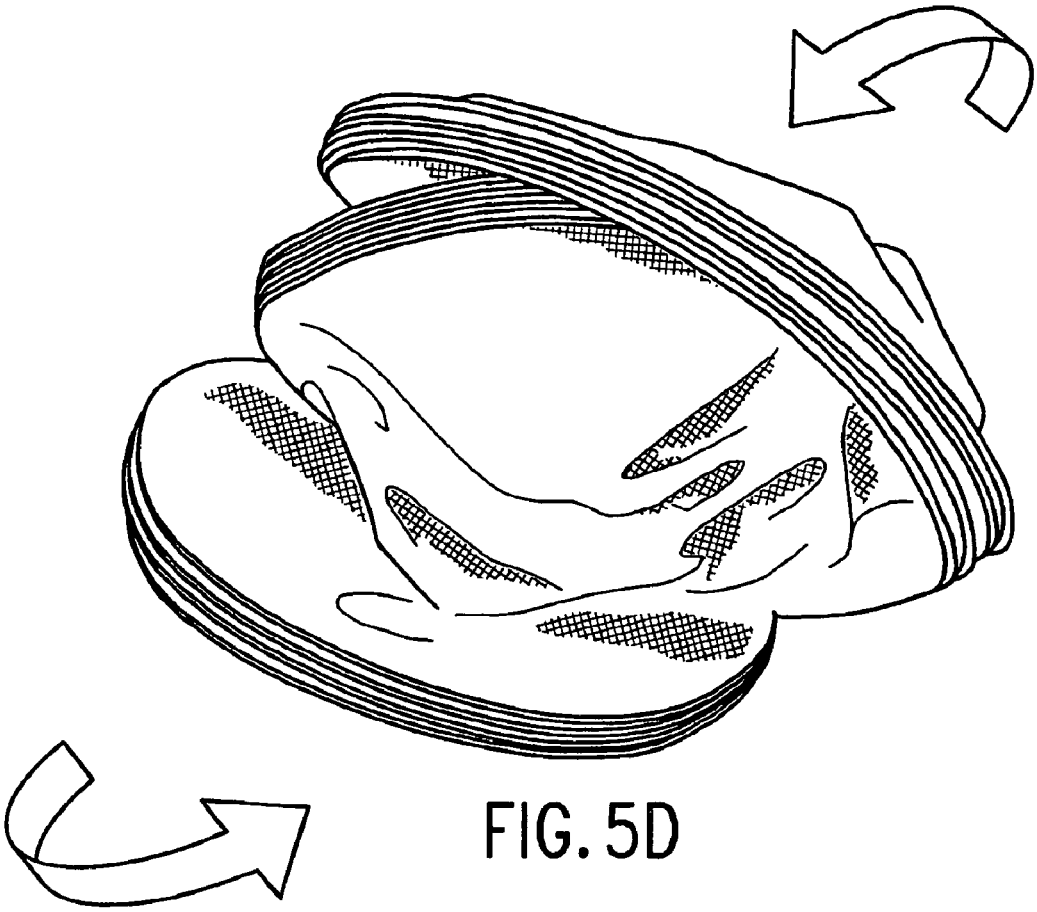
Figure 5E:
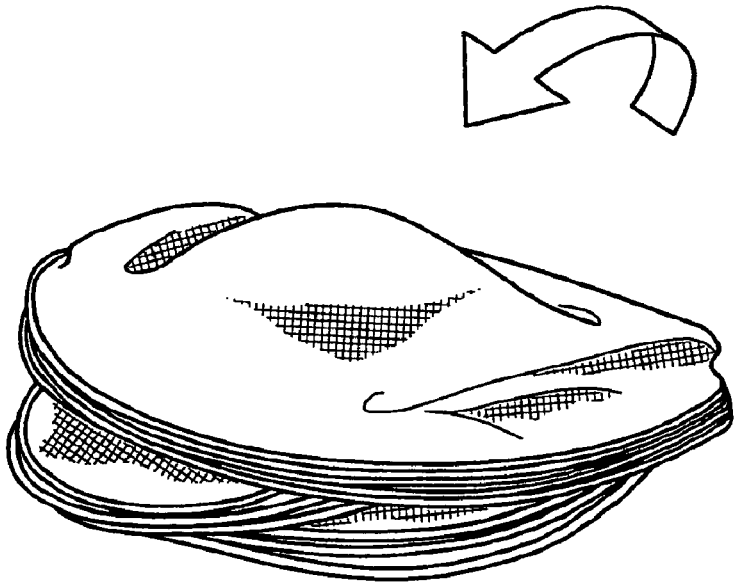

FIGS. 5A through 5E describe the various steps for folding and collapsing the structure 50 of FIG. 4 for storage. As shown in FIG. 5A, the first step consists of pushing in panels 52 and 54 about the hinged connections such that they collapse against panels 58 and 56, respectively. Then, two panels 52 and 58 are folded about the hinged connections so as to be collapsed upon the other two panels 54 and 56 to form a stack of four panels 58, 52, 54, 56 (in one possible order), as shown in FIG. 5B. The stack of panels is then twisted and folded to collapse the frame members and panels into a smaller shape. In the third step shown in FIG. 5C, the opposite border 70 of the stack of panels is folded in upon the previous fold to further collapse the frame members with the panels. As shown in FIG. 5D, the fourth step is to continue the collapsing so that the initial size of the panels is reduced. FIG. 5E shows the fifth step with the frame members and panels collapsed on each other to provide for a small essentially compact configuration having a plurality of concentric frame members and layers of the panels so that the collapsed structure 50 has a size which is a fraction of the initial size of each of the panels.

To re-open the structure 50 to its expanded configuration, the combined stack of panels is unfolded. The memory (i.e., spring-load) of the frame members 34 will cause the frame members 34 to uncoil on their own and to quickly expand the panels to their expanded configuration shown in FIG. 5B. The same principle can be applied to re-open all the other embodiments of the present invention.

Figure 6:
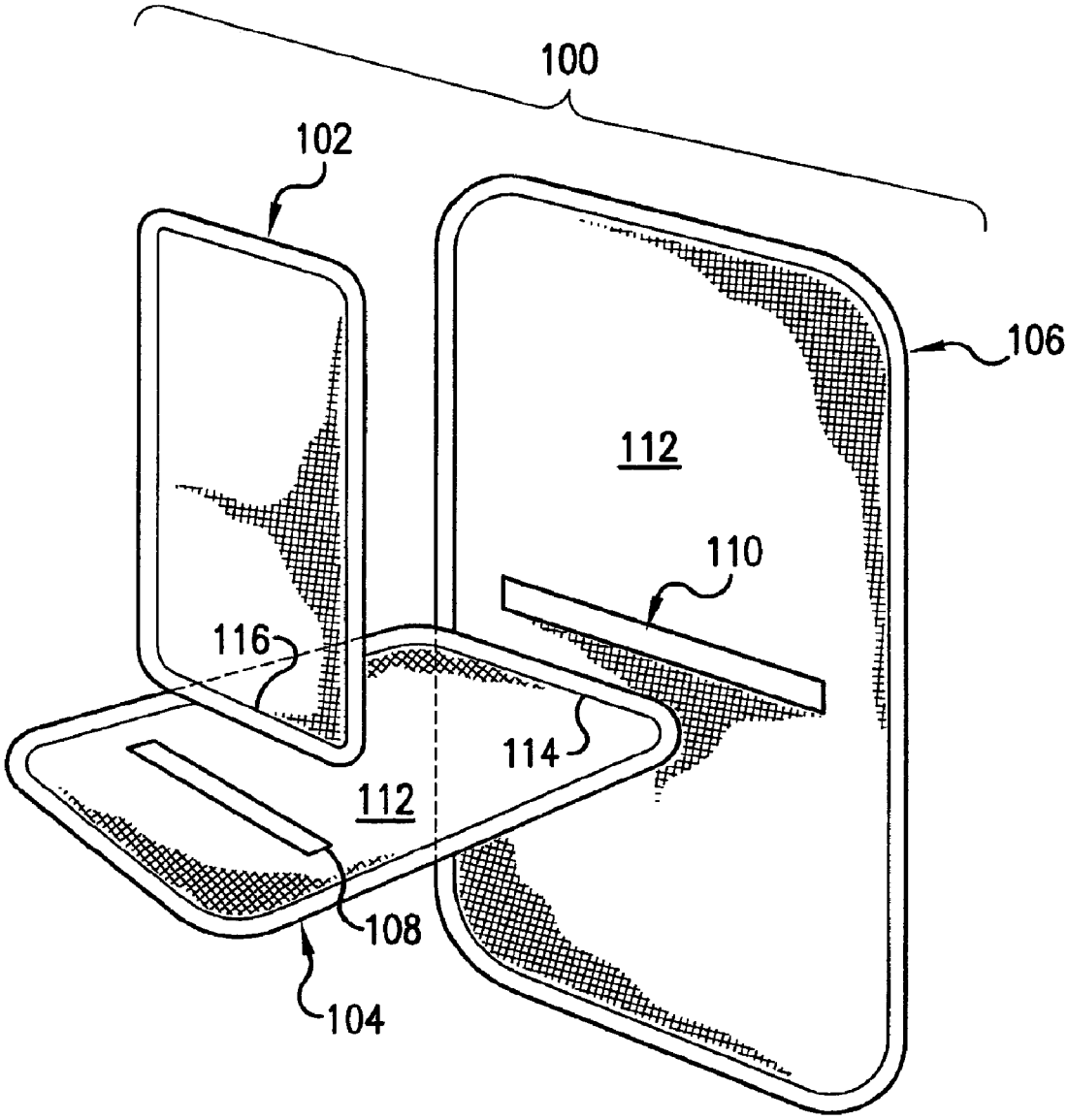
FIG. 6 is an exploded perspective view of a collapsible structure according to yet another embodiment of the present invention.
Figure 7:
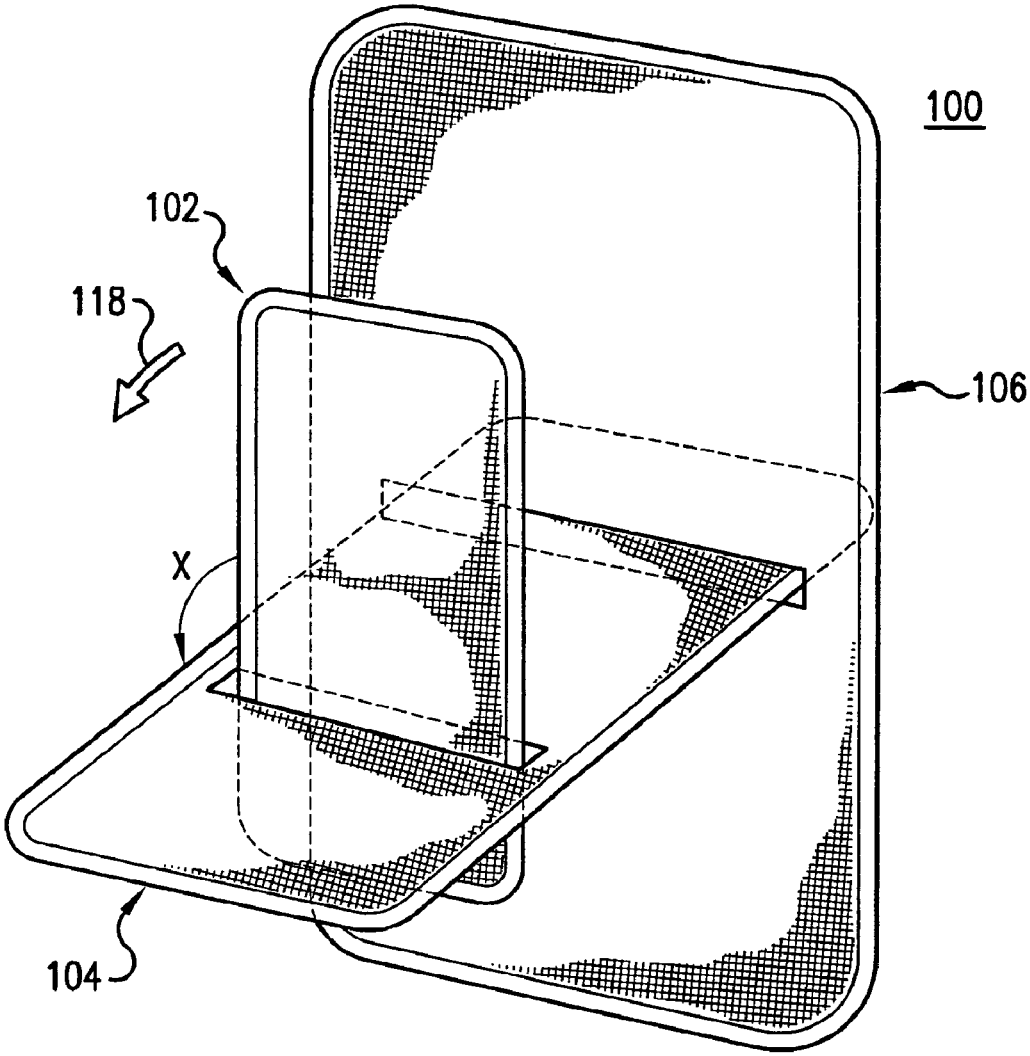
FIG. 7 is a perspective view of the structure of FIG. 6.

According to a second embodiment of the present invention, the fabric of a panel is provided with one or more elongated openings through which another panel can be passed to effectuate a removable connection between the two panels. The basic principles for this embodiment are illustrated in FIGS. 6 and 7, where the structure 100 has three separate panels 102, 104 and 106 that are connected to each other. Each of the panels 102, 104, 106 can have the same construction as panels 22, 24, 26 described above, except for the differences noted hereinbelow. For example, each panel 104 and 106 has an elongated opening 108 and 110, respectively, provided at any location, and in any desired orientation, on the fabric 112 of the panels 104, 106. One side 114 of the panel 104 can be inserted through the opening 110 of the panel 106 to effectuate a joint or connection between the panels 104 and 106. In a similar manner, a side 116 of the panel 102 can be inserted through the opening 108 of the panel 104 to effectuate a joint or connection between the panels 102 and 104. The panels 102 and 104 can be inserted as far through the openings 108 and 110, respectively, as desired to create the desired resulting configuration of the structure 100. In addition, either panel of a joint can be pivoted with respect to the other panel to vary the angle between the two adjacent panels. For example, the panel 102 is shown in FIG. 7 as being generally perpendicular to (i.e., at about 90 degrees with respect to) the panel 104, and generally parallel with the panel 106. However, the panel 102 can be pivoted in the direction of arrow 118 to change the orientation between the two panels 102 and 104, and to change the angle X between the two panels 102 and 104. This will also change the orientation between panels 102 and 106. Any of the three panels 102, 104, 106 can be pivoted in any direction to change the resulting configuration of the structure 100.

Figure 8:
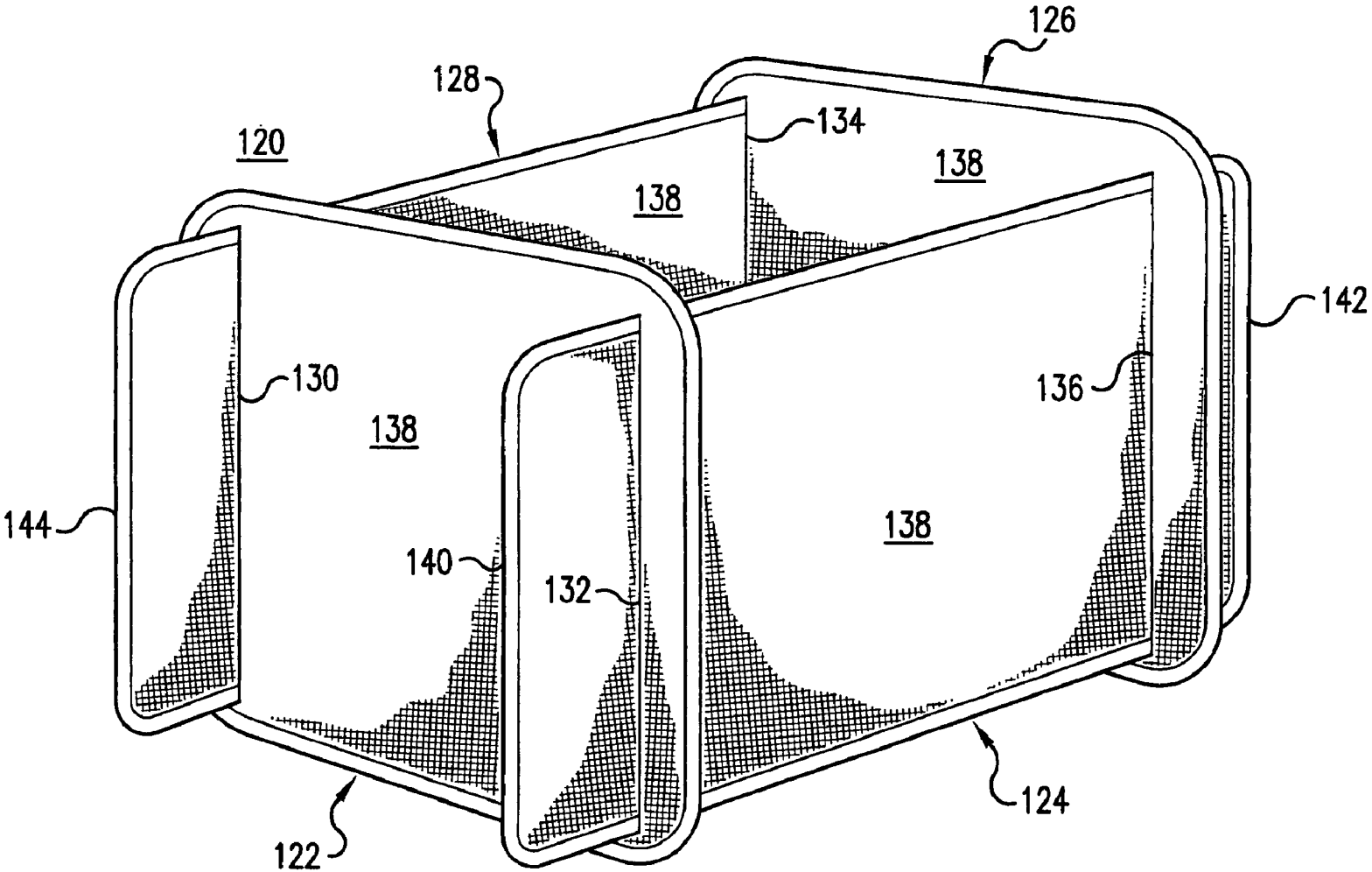
FIG. 8 is a perspective view of a collapsible structure according to a further embodiment of the present invention.

FIG. 8 illustrates another structure 120 that has four separate panels 122, 124, 126 and 128 that are connected to each other. Each of the panels 122, 124, 126, 128 can have the same construction as panels 22, 24, 26 described in FIG. 1 above, except for the differences noted hereinbelow. For example, the panel 122 has two elongated openings 130 and 132, and the panel 126 has two elongated openings 134 and 136. The elongated openings 130, 132, 134, 136 can be provided at any location, and in any desired orientation, on the fabric 138 of the panels 104, 106, although in this embodiment, the openings 130 and 134 should be aligned, and the openings 132 and 136 should be aligned. The alignment of these opening pairs 130, 134 and 132, 136 facilitates the insertion of opposing sides of the other two panels 124, 128 through the aligned openings. For example, one side 140 of the panel 124 can be inserted through the opening 132 of the panel 122 to effectuate a joint or connection between the panels 122 and 124, and the opposing side 142 of the panel 124 can be inserted through the opening 136 of the panel 126 to effectuate a joint or connection between the panels 124 and 126. Similarly, one side 144 of the panel 128 can be inserted through the opening 130 of the panel 122 to effectuate a joint or connection between the panels 122 and 128, and the opposing side (not shown) of the panel 128 can be inserted through the opening 134 of the panel 126 to effectuate a joint or connection between the panels 126 and 128. The panels 124 and 128 can be inserted as far through any of the openings 130, 132, 134, 136 as desired to create the desired resulting configuration of the structure 120, and to vary the size of the enclosed space formed by the four panels 122, 124, 126, 128. Thus, when assembled, the four panels 122, 124, 126, 128 define an enclosed space, with two parallel panels 122 and 126 having elongated openings through which the other parallel panels 124 and 128 may be extended and supported.

The structure 120 can be folded and collapsed for storage using the principles illustrated in FIGS. 5C-5E. In the first step, all the panels of the structure are separated by removing the panels 124 and 128 from the elongated openings 130, 132, 134, 136. Then, the four panels 122, 124, 126, 128 are placed on top of each other to form a stack of four panels. The combined stack of panels is then twisted and folded in the manner shown in FIGS. 5C-5E so that the collapsed structure 120 has a size which is a fraction of the initial size of the structure 120.

In the structures 100 and 120, even though each of the panels 102, 104, 106, 122, 124, 126 and 128 is illustrated as having four sides, this is merely for illustrative purposes and each panel can have any number of sides and can assume any shape and size.

Figure 10:
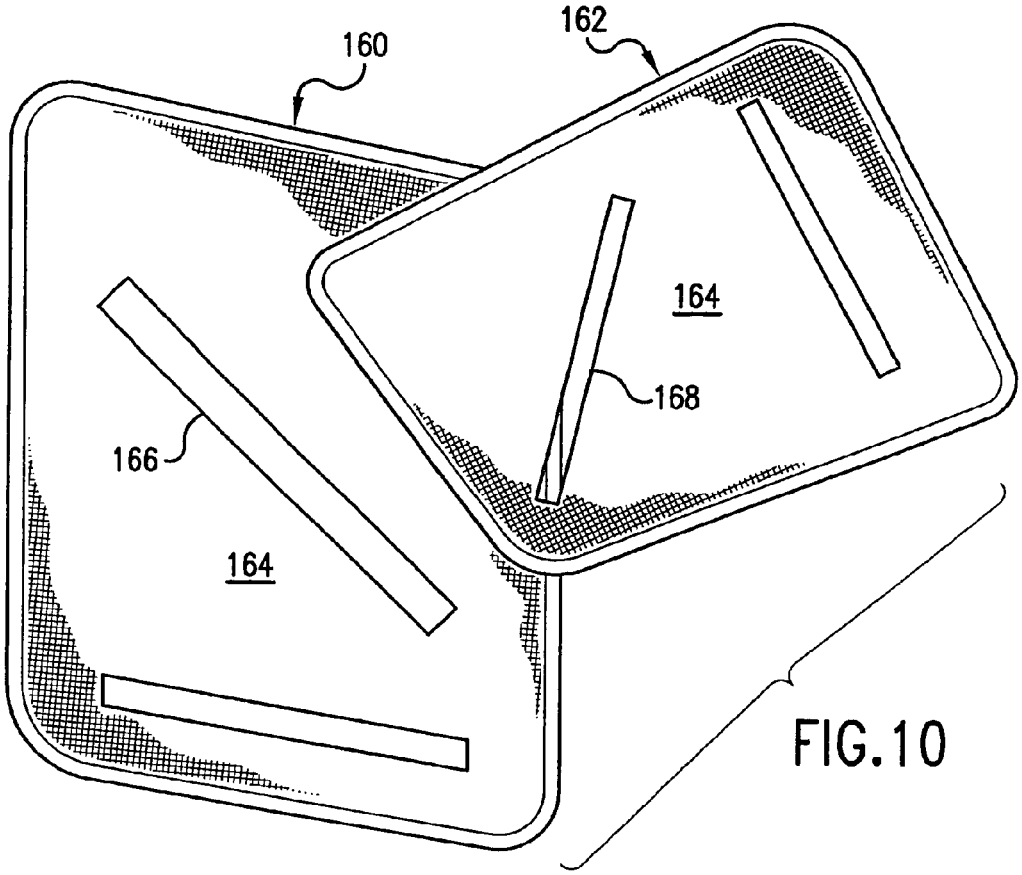
FIG. 10 is a perspective view of a collapsible structure according to yet a further embodiment of the present invention.

The principles illustrated in FIGS. 6-8 provide for the easy assembly and disassembly of the structures, and provide the user with the flexibility to create different configurations. For example, the configurations shown in FIGS. 7 and 8 can be conveniently and quickly assembled by inserting certain panels through elongated openings in other panels. To disassemble these structures 100, 120, the panels can be quickly and conveniently removed and separated, and stacked for folding and collapsing. In addition, a variety of panels having different shapes and sizes can be provided and sold in a package, so that the user can create a structure having as many different panels, each panel having any desired shape and/or size, as desired. In this regard, although the panels 102, 124 and 128 in FIGS. 6-8 are shown as having no elongated openings, it is possible to provide all the panels with elongated openings (such as illustrated in FIG. 10 below) so that the user can use any panel he or she wishes in the creation and assembly of a structure having a configuration of his or her choice. As a result, the principles of the present invention can be used to provide a wide variety of structures, including but not limited to play structures, tents, shelters, partitions, cabanas, and containers.

Another benefit provided by the principles of FIGS. 6-8 is that the joints created by inserting a panel through an elongated opening in an adjacent panel can be rather stable even though these joints are removable. For example, the structure 120 in FIG. 8 is very stable because each panel is supported (albeit in a removable manner) at opposing ends or sides by an adjacent panel.

Figure 9:
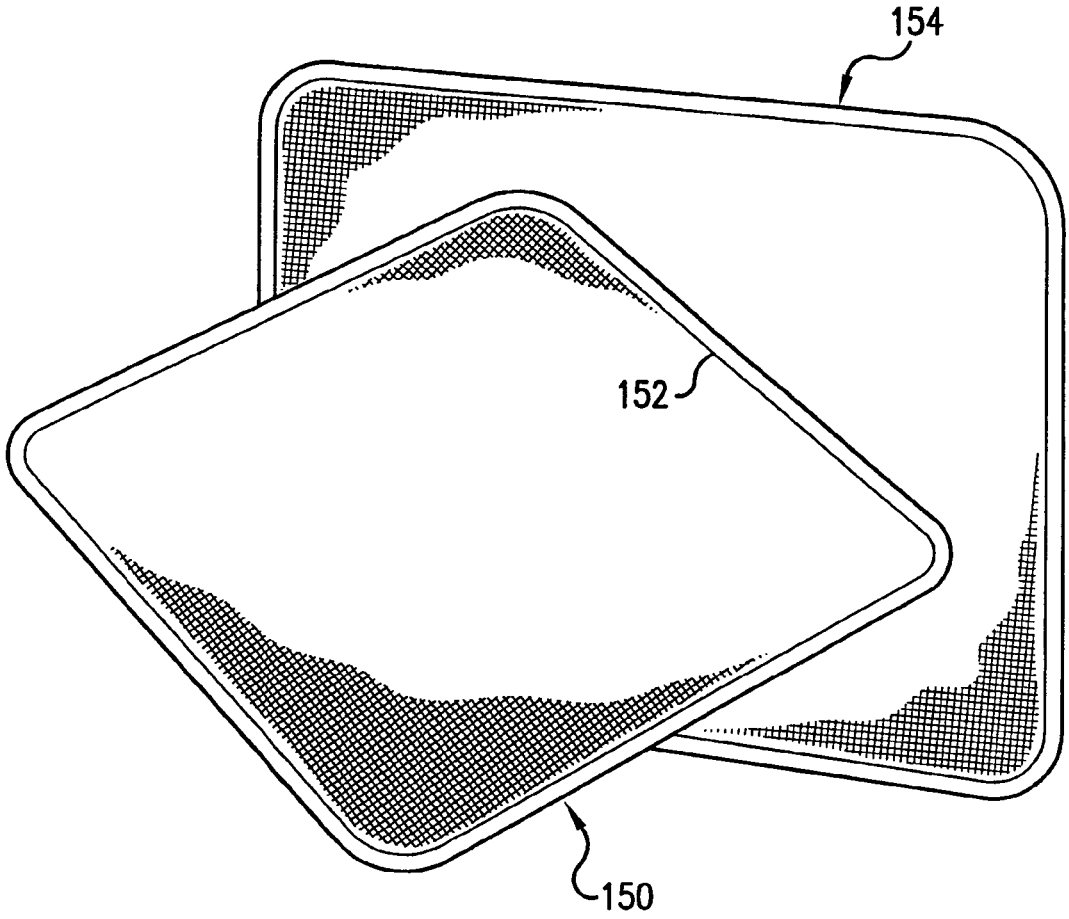
FIG. 9 is a perspective view of a collapsible structure according to yet another embodiment of the present invention.

In addition, although all the connections in FIGS. 1-8 are illustrated as being generally perpendicular or parallel to one or more sides of the panels, it is also possible to provide the connections at almost any angle with respect to the sides of the panels. For example, FIG. 9 illustrates a panel 150 having a side 152 that is coupled to another panel 154 an angle with respect to the sides of the panel 154, using the hinged connection shown in FIG. 3. As another example, FIG. 10 illustrates two panels 160 and 162, each having elongated openings in their fabrics 164 that are angled with respect to the sides of these panels 160, 162. For example, elongated opening 166 is positioned at an angle with respect to the sides of the panel 160, and elongated opening 168 is positioned at an angle with respect to the sides of the panel 162.

Figure 11:
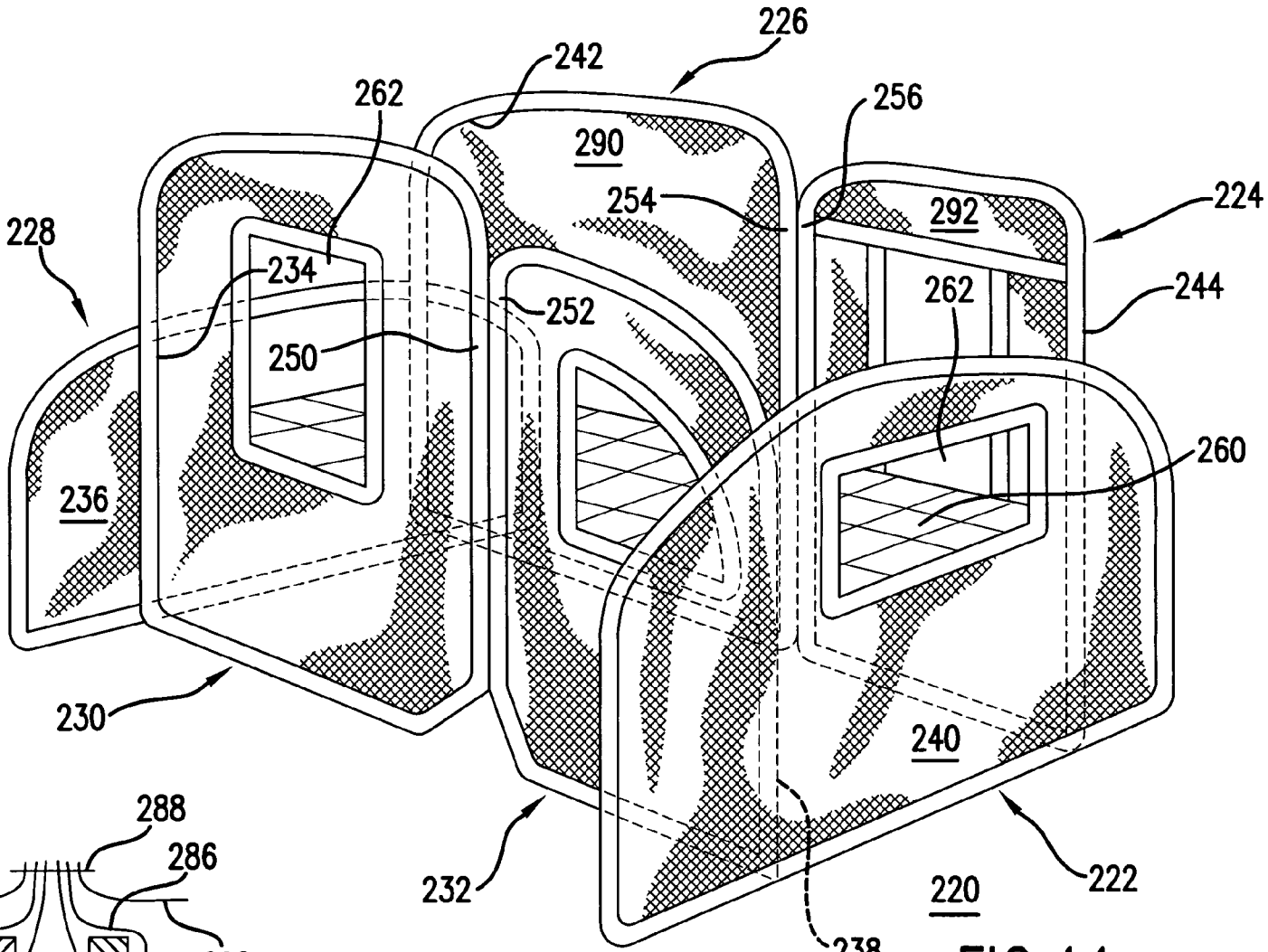
FIG. 11 is a perspective view of a collapsible structure according to yet a further embodiment of the present invention.

FIG. 11 illustrates another structure 220 that has six separate panels 222, 224, 226, 228, 230, 232 that are connected to each other to encircle an enclosed space. Each of the panels 222, 224, 226, 228, 230, 232 can have the same construction as panels 22, 24, 26 described in FIG. 1 above. The panels 222 and 228 are end panels, the panels 224 and 226 make up one side of the structure 220, and the panels 230 and 232 make up another side of the structure 220.

The connections for these panels 222, 224, 226, 228, 230, 232 utilize the principles illustrated in FIGS. 1-5E above, as well as principles illustrated in other patents issued to the present inventor. Specifically, the connection technique illustrated in FIG. 3 can be used to connect (i) one side 234 of the panel 230 to the fabric 236 of the panel 228, (ii) one side 238 of the panel 232 to the fabric 240 of the panel 222, (iii) one side 242 of the panel 226 to the fabric 236 of the panel 228, and (ii) one side 244 of the panel 224 to the fabric 240 of the panel 222. Some of these sides (e.g., 234, 242 and 244) have a greater height than the height of the end panels 222 and 228 that they are connected to, so that an upper portion of these sides 234, 242, 244 would extend above the end panels 222, 228 and be unconnected, with the lower portion of these sides 234, 242, 244 being attached to the fabric 236 and 240 according to the method shown in FIG. 3.

Figure 12:
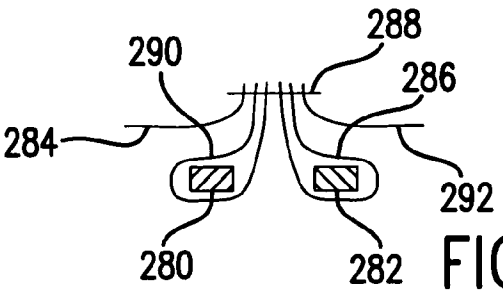
FIG. 12 is an expanded view of the section C of the structure of FIG. 11 illustrating a connection between two adjacent panels.

In addition, the side 254 of the panel 226 is hingedly attached to the side 256 of the panel 224 using the techniques described in connection with any of FIGS. 2A-2B of U.S. Pat. No. 5,816,279, whose disclosure is incorporated by this reference as though set forth fully herein. FIG. 12 herein illustrates the technique shown in FIG. 2A of U.S. Pat. No. 5,816,279, with the frame members 280 and 282 of the panels 226 and 224, respectively, retained in separate frame retaining sleeves 284 and 286, respectively. The frame retaining sleeves 284 and 286 are stitched by a stitching 288 to the fabric 290 and 292 of the panels 226 and 224, respectively, to form a hinged connection between the panels 226 and 224. The side 250 of the panel 230 is hingedly connected to the side 252 of the panel 232 using the same method illustrated in FIG. 12.

The structure 220 can be used as a tent or enclosure that surrounds a conventional bed 260. In this regard, openings 262 can be provided in the fabric of any of the panels 222, 224, 226, 228, 230, 232 to function as windows for the enclosure, or as openings for a child to enter and leave the enclosure. In addition, either end panel 222 or 228 can function as a head board for the bed 260. Each panel 222, 224, 226, 228, 230, 232 can be provided in different shapes and sizes (or in the same shape and size) to provide different aesthetic arrangements for the desired enclosure.

The structure 220 in FIG. 11 can be modified so that the panels 224 and 232 can be omitted, so that both sides 234 and 250 of the panel 230 are attached to the fabric of the panels 228 and 222, respectively, and both sides 242 and 254 of the panel 226 are attached to the fabric of the panels 228 and 222, respectively, using the method illustrated in FIG. 3.

The structure 220 in FIG. 11 can also be modified so that one of the connections between adjacent panels (e.g., the connection of the side 234 to the fabric 236, or the connection of the sides 250 and 252) is a removable connection that can be removably connected by a removable connection mechanism (e.g., VELCRO™ pads, toggles, hooks, etc.), so that the two adjacent panels (e.g., 228 and 230, or 230 and 232) can be separated to allow egress from and ingress to the space enclosed by the panels 222, 224, 226, 228, 230, 232.

The structure 220 can be stored by folding the panels 222, 224, 226, 228, 230, 232 on top of each other (about the hinged connections) to form a stack of six panels, and then folded and collapsed for storage using the principles illustrated in FIGS. 5C-5E.

Thus, the embodiments of the present invention increase the applications and use of the collapsible structures to provide the user with an unlimited source and variety of fun and entertainment. The shapes and sizes of the panels and the structures can be varied or combined, as well as the entertainment features.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A collapsible structure, comprising:

a first end panel and a second end panel that is parallel to the first end panel, each end panel having a foldable frame member having a folded and an unfolded orientation, with a fabric covering the frame member to form the respective end panel when the frame member is in the unfolded orientation, each end panel further defining a periphery;

a first side wall having at least one panel, a first side and a second side;

a second side wall having at least one panel, a first side and a second side;

each panel of the side walls having a foldable frame member having a folded and an unfolded orientation;

wherein the first side of the first side wall is stitched to the fabric of the first end panel at a location away from the periphery of the first end panel;

the second side of the first side wall is stitched to the fabric of the second end panel at a location away from the periphery of the second end panel;

the first side of the second side wall is stitched to the fabric of the first end panel at a location away from the periphery of the first end panel; and the second side of the second side wall is stitched to the fabric of the second end panel at a location away from the periphery of the second end panel.

2. The structure of claim 1, wherein the height of the first end panel is less than the height of the first and second side walls.

3. The structure of claim 1, wherein the first side wall comprises a first side panel and a second side panel, with the first and second side panels each having a first side and a second side, with the first side of the first side panel stitched to the second side of the second side panel.

4. The structure of claim 3, wherein the second side of the first side panel is stitched to the first end panel and the first side of the second side panel stitched to the second end panel.

5. The structure of claim 1, wherein each panel further includes a frame retaining sleeve that retains the frame member for the respective panel, with the fabric for each panel stitched to the respective frame retaining sleeve.

6. The structure of claim 5, wherein the frame retaining sleeve of the at least one panel of the first side wall along its first side is stitched to the fabric of the first end panel.

7. A collapsible structure, comprising:

a first end panel and a second end panel that is parallel to the first end panel, each end panel having a foldable frame member having a folded and an unfolded orientation, with a fabric covering the frame member to form the respective end panel when the frame member is in the unfolded orientation, each end panel further defining a periphery;

a first side wall having at least one panel, a first side and a second side;

a second side wall having at least one panel, a first side and a second side;

each panel of the side walls having a foldable frame member having a folded and an unfolded orientation;

wherein the first side of the first side wall is stitched to the fabric of the first end panel at a location away from the periphery of the first end panel;

the first side of the second side wall is stitched to the fabric of the first end panel at a location away from the periphery of the first end panel; and the second side of the first side wall and the second side wall are coupled to the second end panel.

8. The structure of claim 7, wherein the height of the first end panel is less than the height of the first and second side walls.

9. The structure of claim 7, wherein the first side wall comprises a first side panel and a second side panel, with the first and second side panels each having a first side and a second side, with the first side of the first side panel stitched to the second side of the second side panel.

10. The structure of claim 7, wherein each panel further includes a frame retaining sleeve that retains the frame member for the respective panel, with the fabric for each panel stitched to the respective frame retaining sleeve.

11. The structure of claim 10, wherein the frame retaining sleeve of the at least one panel of the first side wall along its first side is stitched to the fabric of the first end panel.

12. A collapsible structure, comprising:

a first end panel and a second end panel that is parallel to the first end panel, each end panel having a foldable frame member having a folded and an unfolded orientation, with a fabric covering the frame member to form the respective end panel when the frame member is in the unfolded orientation, each end panel further defining a periphery;

a side wall having at least one panel, a first side and a second side, each of the at least one panel having a foldable frame member having a folded and an unfolded orientation;

wherein the first side of the side wall is stitched to the fabric of the first end panel at a location away from the periphery of the first end panel; and the second side of the side wall is stitched to the fabric of the second end panel at a location away from the periphery of the second end panel.

13. The structure of claim 12, wherein the height of the first end panel is less than the height of the side wall.

14. The structure of claim 12, wherein the first side wall comprises a first side panel and a second side panel, with the first and second side panels each having a first side and a second side, with the first side of the first side panel stitched to the second side of the second side panel.

15. The structure of claim 14, wherein the second side of the first side panel is stitched to the first end panel and the first side of the second side panel stitched to the second end panel.

16. The structure of claim 12, wherein each panel further includes a frame retaining sleeve that retains the frame member for the respective panel, with the fabric for each panel stitched to the respective frame retaining sleeve.

17. The structure of claim 16, wherein the frame retaining sleeve of the at least one panel of the side wall along its first side is stitched to the fabric of the first end panel.

* * * * *